US010746502B1

(12) United States Patent
Bynoe et al.

(10) Patent No.: US 10,746,502 B1
(45) Date of Patent: Aug. 18, 2020

(54) FIREARM HOLSTERS, DEVICES FOR ATTACHING TO A FIREARM HOLSTER AND METHODS FOR PROVIDING A FIREARM HOLSTER ATTACHABLE TO INSIDE A WEARER'S WAISTBAND OR OUTSIDE THE WEARER'S WAISTBAND

(71) Applicants: Tomilson Bynoe, St. Lucy (BB); Carl Collins, Westminster, SC (US)

(72) Inventors: Tomilson Bynoe, St. Lucy (BB); Carl Collins, Westminster, SC (US)

( * ) Notice: Subject to any disclaimer, the term of this patent is extended or adjusted under 35 U.S.C. 154(b) by 0 days.

(21) Appl. No.: 16/271,799

(22) Filed: Feb. 9, 2019

(51) Int. Cl.
*F41C 33/04* (2006.01)
*F41C 33/02* (2006.01)

(52) U.S. Cl.
CPC ..... *F41C 33/041* (2013.01); *F41C 33/0209* (2013.01); *F41C 33/048* (2013.01)

(58) Field of Classification Search
CPC .. F41C 33/041; F41C 33/0209; F41C 33/048; F41C 33/043; F41C 33/045
USPC ..... 224/194
See application file for complete search history.

(56) References Cited

U.S. PATENT DOCUMENTS

| | | | | |
|---|---|---|---|---|
| 6,264,079 | B1 * | 7/2001 | Skaggs | F41C 33/0236 224/193 |
| 8,109,420 | B2 * | 2/2012 | Martinez | A45F 5/02 224/197 |
| 9,086,254 | B1 * | 7/2015 | Plappert | F41C 33/041 |
| 10,220,902 | B2 * | 3/2019 | Boas | B62J 7/08 |
| 2015/0034684 | A1 * | 2/2015 | Tedder | A45F 5/021 224/242 |
| 2018/0010885 | A1 * | 1/2018 | Tedder | F41C 33/0209 |
| 2018/0325248 | A1 * | 11/2018 | Tedder | A45F 5/021 |

* cited by examiner

*Primary Examiner* — Derek J Battisti
(74) *Attorney, Agent, or Firm* — Derek Fahey

(57) ABSTRACT

A device for attaching to a firearm holster such that the firearm hostler is attachable inside or outside a wearer's waistband. The device includes a ring assembly and a hook assembly. The hook assembly attaches the holster body to a waistband or a belt of the wearer. The device also includes a clasp assembly that attaches to the hook assembly. The clasp assembly is configured for removably attaching the hook assembly to the ring assembly such that the hook assembly is positioned either in a first configuration or a second configuration. In the first configuration the hook assembly is configured to hook onto the waistband when the holster body is worn inside the wearer's waistband. In the second configuration the hook assembly is configured to hook onto the belt or waistband when the holster body is worn outside the wearer's waistband.

20 Claims, 15 Drawing Sheets

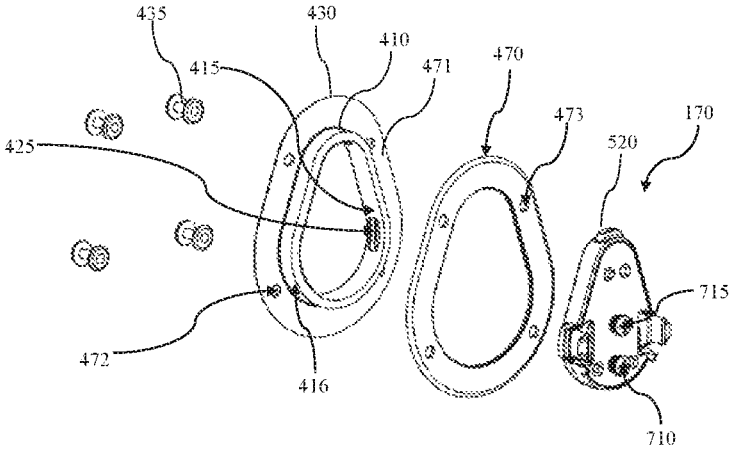
FIG. 4A1

FIREARM HOLSTERS, DEVICES FOR ATTACHING TO A FIREARM HOLSTER AND METHODS FOR PROVIDING A FIREARM HOLSTER ATTACHABLE TO INSIDE A WEARER'S WAISTBAND OR OUTSIDE THE WEARER'S WAISTBAND

CROSS-REFERENCE TO RELATED APPLICATIONS

Not applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to firearms, and more specifically to holsters for firearms.

BACKGROUND

Firearms have been used for centuries. There are many different types of firearms. Examples of firearms may be rifles, shotguns, machine guns, assault rifles, small arms and handguns. A handgun is a short barrel firearm designed to be fired using only one hand. Handguns may include revolvers and semi-automatic pistols. Holsters may be used to store handguns when not in use. Holsters are generally designed to offer protection to the handgun, secure its retention, and provide access to a handgun when necessary. Holsters are generally designed to be used with one hand, allowing the handgun to be removed and/or replaced with the same hand. To be able to return the handgun to its holster one-handed, the holster must be made from stiff material that holds its shape so that the holster will not collapse when the object is no longer inside to give it support. Holster designs for firearms come in a wide range of shapes, materials, and retention/release mechanisms, from simple leather pouches hanging from a belt to highly protective holsters with flaps that cover the entire handgun, to highly adjustable competition holsters that hold the handgun at a precise position and release instantly when activated.

There are two popular types of holsters or belt holsters. One is an outside the waistband (OWB) holster. OWB holster is commonly used by police and military and citizens who choose to carry firearms. The second type of popular holster is an inside the waistband (IWB) holster, which will clip or mount to a belt and allow one to securely holster a weapon inside the pants. Many people desire to have both OWB holster and an IWB holster because an OWB holster may be useful in certain situations, while in other situations the IWB may be more useful in different situations. However, currently there is not a holster that properly secures to both inside a user's waistband and outside a user's waistband. As a result, there exists a need for improvements over the prior art and more particularly for a more efficient way and holster of allowing a user to have both a holster that may be an OWB holster and an IWB holster.

SUMMARY

Firearm holsters, devices for attaching to a firearm holster and methods for providing a firearm holster attachable to inside a wearer's waistband or outside the wearer's waistband disclosed. this summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a device for attaching to a firearm holster such that a holster body of the firearm hostler is attachable to either inside a wearer's waistband or outside the wearer's waistband is disclosed. The device includes at least one ring assembly configured to be disposed on the holster body. The device also includes at least one hook assembly having a hook shaped body defining a longer portion, a shorter portion and a curved portion. Then at least one hook assembly is configured to attach the holster body to at least one of a waistband and a belt of a wearer. The device also includes a clasp assembly configured to attach to each hook assembly. Each clasp is configured for removably attaching the hook assembly to the ring assembly such that the hook assembly is positioned on either a first side of the holster body in a first configuration or on a second side of the holster body in a second configuration. In the first configuration the hook assembly is configured to hook onto the waistband for when the holster body is worn inside the wearer's waistband. In the second configuration the hook assembly is configured to hook onto at least one of the belt or waistband for when the holster body is worn outside the wearer's waistband.

In a second embodiment, a firearm holster attachable to at least one of inside a wearer's waistband and outside the wearer's waistband is disclosed. The firearm holster includes a holster body configured for receiving a firearm. The firearm holster also includes at least one ring assembly opening on the holster body. Each ring assembly opening is configured for receiving a ring assembly. Each ring assembly is configured to be removably attached to at least one ring assembly opening. At least one hook assembly is configured to attach the holster body to at least one of a waistband and a belt of the wearer. A clasp assembly is attached to each hook assembly. The clasp assembly is configured for removably attaching the hook assembly to the ring assembly such that the hook assembly may be positioned on either a first side of the holster body in a first configuration or on a second side of the holster body in a second configuration. In the first configuration the hook assembly is configured to hook onto the waistband when the holster body is worn inside the wearer's waistband. In the second configuration the hook assembly is configured to hook onto at least one of the belt and waistband when the holster body is worn outside the wearer's waistband.

In another embodiment, a method for providing a firearm holster attachable to either inside a wearer's waistband or outside the wearer's waistband is disclosed. The method includes providing at least one ring assembly opening on a holster body of the firearm holster. Each ring assembly opening configured for receiving a ring assembly. The method further includes providing at least one ring assembly, wherein each ring assembly is configured to be removably attached to the at least one ring assembly opening. The method further includes providing at least one hook assembly configured to attach the holster body to at least one of a waistband and a belt of the wearer. The method further includes providing a clasp assembly attached to each hook assembly, wherein the clasp assembly is configured for removably attaching the hook assembly to the ring assembly such that the hook assembly is positioned on at least one of a first side of the holster body in a first configuration and on a second side of the holster body in a second configuration. In the first configuration the hook assembly is configured to hook onto the waistband when the holster body is worn inside the wearer's waistband. In the second configuration the hook assembly is configured to hook onto at least one of the belt and waistband when the holster body is worn outside the wearer's waistband.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein:

FIG. 4A1 is an exploded preceptive view of the ring assembly and perspective view of the clasp assembly, according to an example embodiment;

DETAILED DESCRIPTION

Figure 1A:
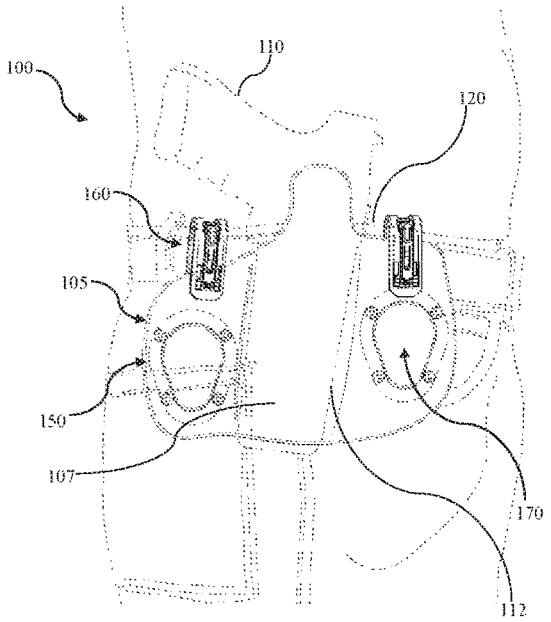
FIG. 1A is a preceptive view of a device for attaching to a firearm holster and firearm holster attachable to inside and outside a wearer's waistband, wherein the device and firearm holster are positioned inside a wearer's waistband, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing devices, holsters and methods for providing holsters that allow the user or wearer to position the holster both inside a user's waistband and outside his waistband. The disclosed embodiments improve over the prior art by providing a hook assembly that is attachable in both a first configuration and a second configuration via a clasp assembly, in the first configuration, the holster body of the holster is configured to be worn inside the wearer's waistband. In the second configuration, the holster body of the holster is configured to be worn outside the wearer's waistband. The disclosed embodiments also improve over the prior art by providing a retractable tooth that acts as a stop that prevents the holster body from being removed from a wearer's waistband. The disclosed embodiments also improve over the prior art by providing a movable hook that is configured to hook onto the holster body such that the holster body is prevented from moving away from a wearer's waistband.

Figure 1B:
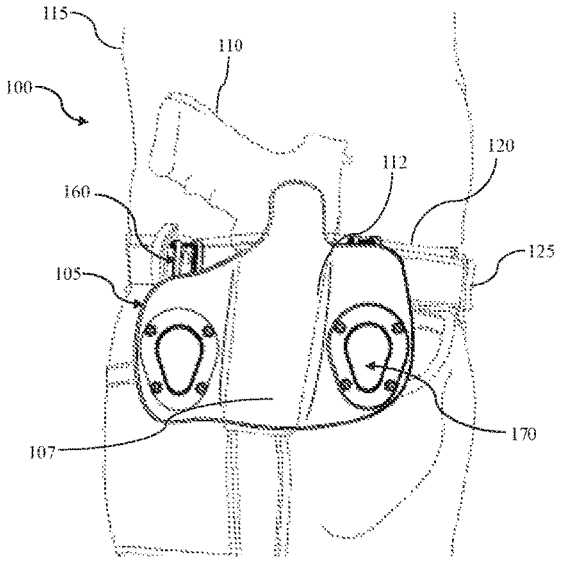
FIG. 1B is a preceptive view of the device for attaching to a firearm holster and firearm holster attachable to inside and outside a wearer's waistband, wherein the device and firearm holster are positioned outside a wearer's waistband, according to an example embodiment.
Figure 1C:
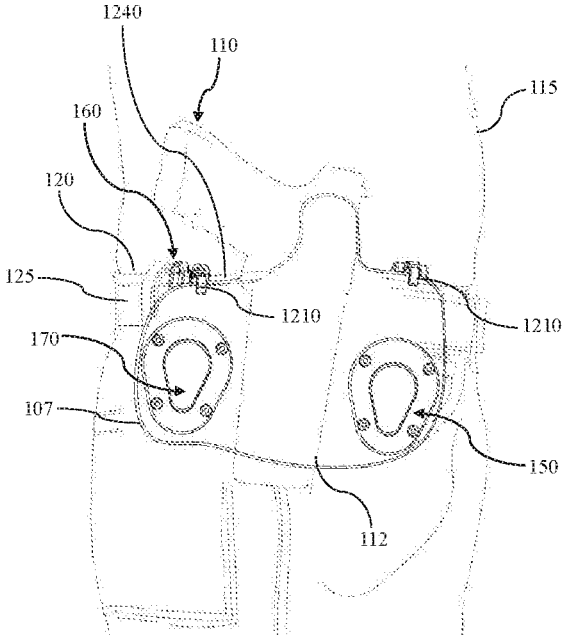
FIG. 1C is a preceptive view of the device for attaching to a firearm holster and firearm holster attachable to inside and outside a wearer's waistband, wherein the device and firearm holster are positioned outside a wearer's waistband and movable hook maintains the holster body close to the wearer's waistband, according to an example embodiment.

Referring now to the Figures, FIGS. 1A-1C will be discussed together and will be discussed individually to point out certain elements. FIG. 1A-1C are preceptive views of a device 100 for attaching to a firearm holster and firearm holster attachable with the waistband of the wearer 115. The waistband in certain embodiments may be defined as the belt and the strip of material that forms the waist of a pair of trousers or a skirt. The firearm holster has a holster body 107 that defines a pocket for receiving a firearm 110 (further explained below). In FIG. 1A, the device and firearm holster are attached inside a wearer's waistband 120 thereby providing an OWB holster. In FIG. 1A, some of the hashed lines on the holster body 107 and device 100 illustrate the firearm holster is positioned inside and in attachment with the waistband. In FIG. 1B, the device 100 and firearm holster 107 are positioned and attached to the outside of the wearer's waistband thereby providing an OWB holster. In FIG. 1B, the hashed vertical hashed lines 112 illustrated the pocket within which the barrel of firearm 110 is received. In FIG. 1C similar to FIG. 1B, FIG. 1C, provides an OWB holster wherein the device 100 is configured to attach the holster body 107 to the outside of the wearer's waistband. In all of the embodiments, a clasp assembly 170 attaches the hook assembly 160 to a ring assembly 150. The ring assembly is attached to ring assembly openings along the holster body 107. In all of the embodiments, the hook assembly 160 hooks the device to the waistband of the wearer. FIG. 1C illustrates a movable hook 1210 of the hook assembly in a second position or a hooking position. In the hooking position, the movable hook helps to maintain the holster body 107 proximate to the waistband of a wearer 115 such that the weight of the firearm does not pull the firearm off to the side and away from the body and waist of the wearer's body.

Figure 2:
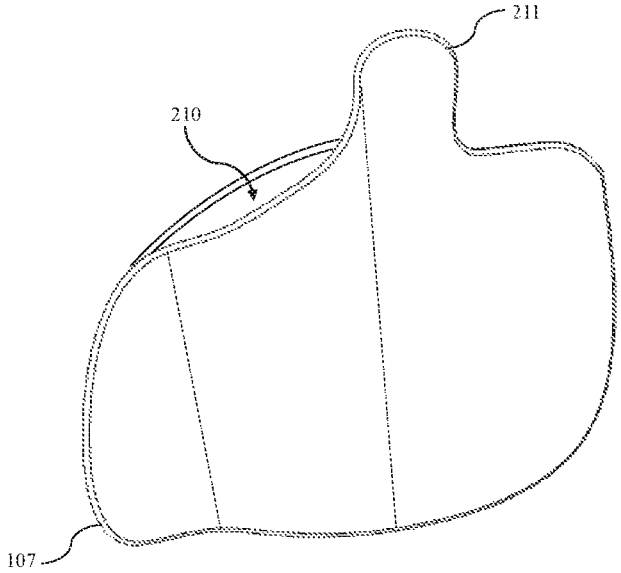
FIG. 2 is a preceptive view of a holster body of the firearm holster for the device for attaching to a firearm holster and firearm holster attachable to inside and outside a wearer's waistband, according to an example embodiment.
Figure 3:
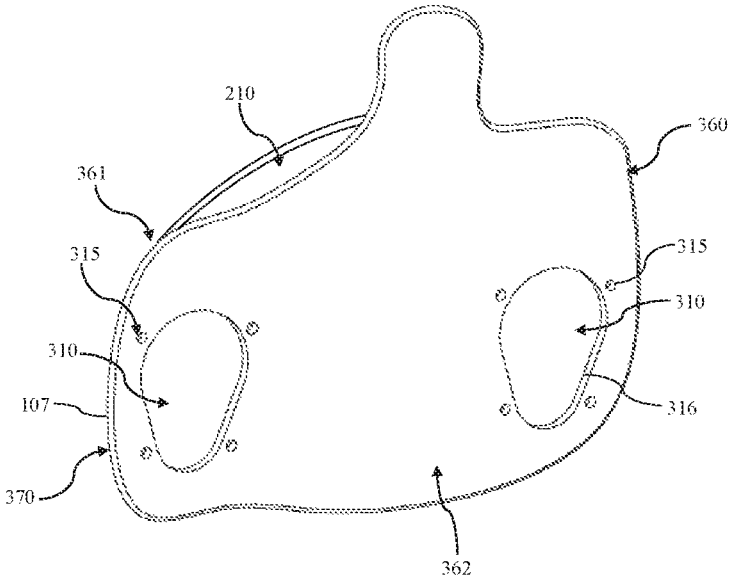
FIG. 3 is a preceptive view of the holster body having ring assembly openings disposed on a holster body of the firearm, according to an example embodiment.

FIG. 2 is a preceptive view of a firearm holster 105 for the device 100. It is understood that the invention may be a device for attaching to the firearm holster or may be a device that is configured to be attached to the holster itself or also may be the holster containing the device. The holster body 107 may comprise a single part or may be manufactured from multiple parts. The also may comprise material such as leather, nylon, plastics over other types of materials. It is understood that other materials may be used within the spirit and scope of the present invention. The holster body defines a pocket 210. The pocket 210 is configured such that it receives the barrel of a firearm (as illustrated in FIGS. 1-3. The holster body may also or may not define a riser 211 on either side of the pocket. The pocket may be aligned with other materials. FIG. 3 is a preceptive view of the firearm holster having ring assembly openings 310 disposed on a holster body 107 of the firearm, according to an example embodiment. Each ring assembly opening is surrounded by an inward facing wall 316 of the holster body 107. In the present embodiments, the holster body has two ring assembly openings, one proximate to the forward end 360 and one proximate to the rearward and 370 of the holster body. The present embodiments, the ring assembly openings defined a substantially oval shaped opening, however other shapes may be used that are within the spirit and scope of the present invention. The ring assembly openings allow the ring assembly to be attached with the holster body 107 while still maintaining the integrity of the pocket for receiving a firearm. In the present embodiment, each of the ring assembly openings spans from the inside facing side 361 to the outward facing side 362 of the holster assembly. Supplemental ring assembly openings 315 may be used for allowing fasteners to facilitate attaching the ring assembly to the ring assembly openings. In operation, a user may actually use a tool to provide the ring assembly openings and supplemental ring assembly openings on the holster body 107. In one embodiment, the tool may include a knife, a device with a sharp edge for creating holes in all types of material. However, it is understood that other tools may be used within the spirit of the present invention.

Figure 4A:
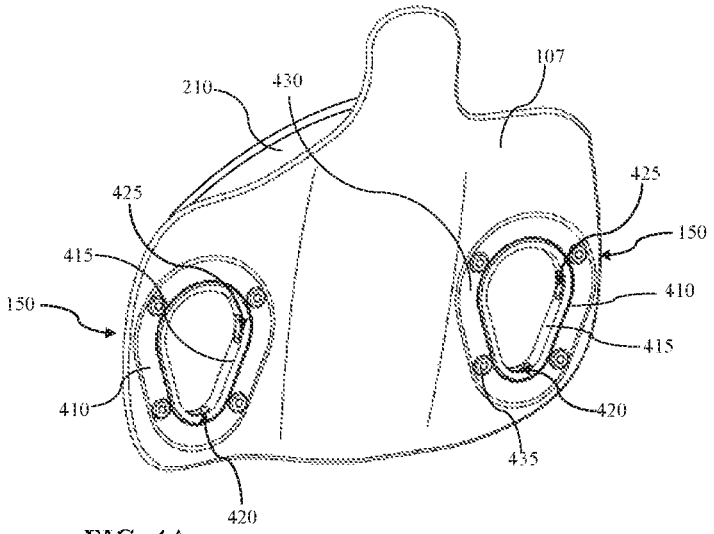
FIG. 4A is a preceptive view of the ring assembles attached to the ring assembly openings, according to an example embodiment.

Referring to FIGS. 4A and 4A1, each ring assembly has a ring shaped body 410. The ring shaped body has an inward facing wall 415 and an outward facing wall 416. In the present embodiments, the ring shaped body is a substantially oval shaped ring body. The outer portion of the outward facing wall 416 is configured to abut the inward facing edge 316 that surrounds the ring assembly opening. At least one positioning cavity 420 is defined along the inward facing wall. The positioning cavity is configured to receive a positioning tab 520 (further explained below) when in the fully assembled configuration. At least one catch cavity 425 is defined along the inward facing wall. In the present embodiment, two catch cavities are along the inward facing wall. The positioning cavity 420 defines space that is configured for receiving the positioning tab 520 (further explained below) of the catch assembly when the catch tabs are in the outward configuration or position. Each of the catch cavities define space that are configured for receiving the catch tabs 525 (further explained below) of the catch assembly when the catch tabs are in the outward configuration or position. A flanged portion 430 is perpendicular to the ring-shaped body. Surface 471 is configured to abut a side of the holster body 107 (as illustrated in FIG. 4A) when the ring assembly is attached to the holster body. The flanged portion also includes flanged portion openings 472 along the flanged portion. Each of flanged portion opening 472 for receiving a fastener 435 to attach the ring-shaped body to the holster body. The fastener may include a rivet or any other type of fastener that the faster that may attach the flange portion 430 to the holster body such that the positioning cavity and catch cavities may receive the tabs of the clasp assembly from either the first side or second side of the holster body. In one embodiment, the ring assembly may also include a plate 470 that is configured for attaching to the opposite side to which the flanged portion of the ring assembly is attached. In operation, to install the ring assembly to the holster body, a user will position the flanged portion of the ring assembly such that the outward facing surface 416 of the ring body abuts inward facing surface 316 of the holster body 107. Additionally, the openings 472 along the flange portion should align with the supplemental openings 315 along the holster body. Optionally, the user will position the plate 470 on the side of the holster body opposing the flanged portion such that the plate openings or holes 473 are aligned with the openings 472. Next, a user can pass the fasteners 435 through the openings 472 and 473 in order to secure the ring assembly to the holster body.

Figure 4B:
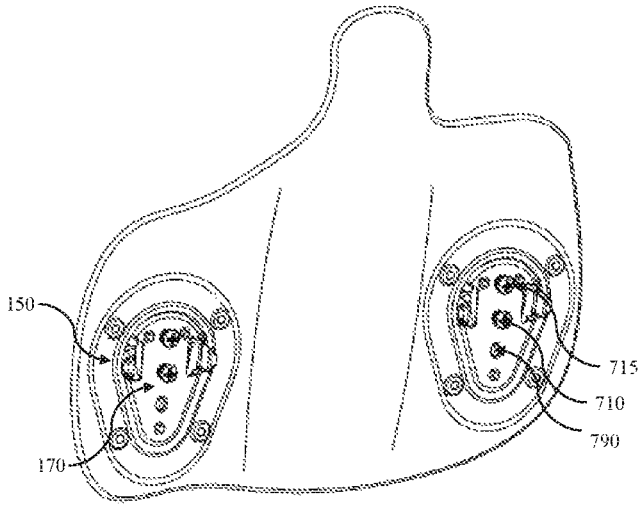
FIG. 4B is a preceptive view of the firearm holster having clasp assemblies clasped to the ring assembles, according to an example embodiment.
Figure 5:
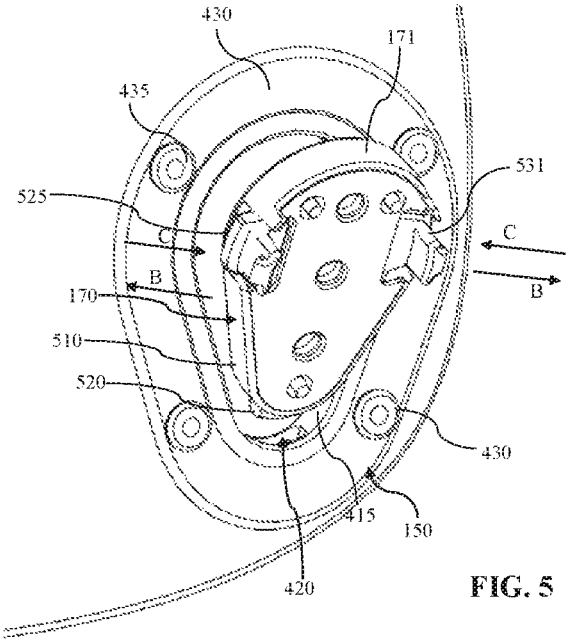
FIG. 5 is a preceptive view of the firearm holster having a clasp assembly being positioned to engage the ring assembly, according to an example embodiment.
Figure 6A:
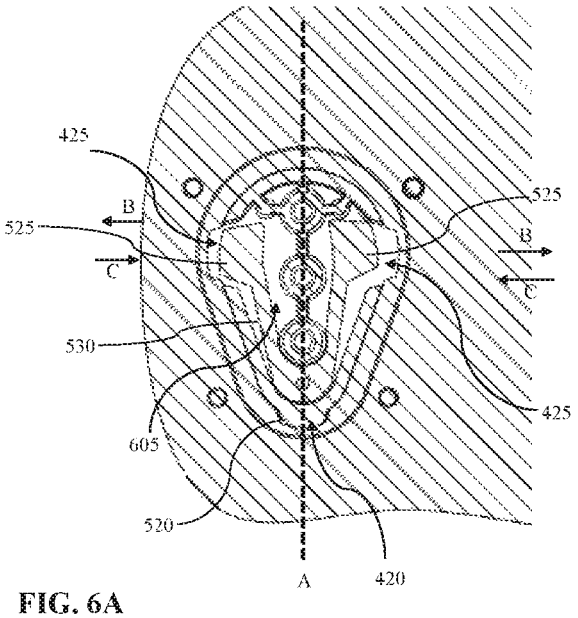
FIG. 6A is a cross sectional side view of the firearm holster having a clasp assembly engaging the ring assembly with the catch tabs in an inward position, according to an example embodiment.
Figure 6B:
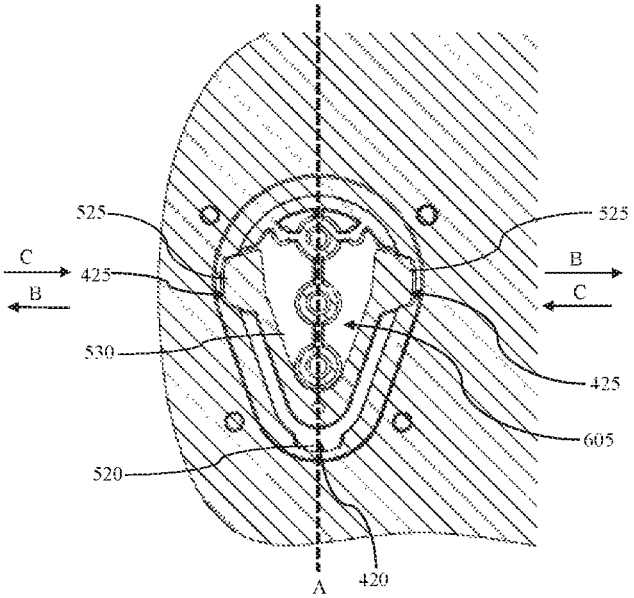
FIG. 6B is a cross sectional side view of the firearm holster having a clasp assembly engaging the ring assembly with the catch tabs in an outward position, according to an example embodiment.

FIGS. 4B, 5 and 6A-B will be discussed together, and individual items and figures may be pointed where necessary. FIG. 4B is a preceptive view of the firearm holster having clasp assemblies 170 clasped to the ring assembles 150, according to an example embodiment. In FIG. 4B, it illustrates that each clasp assembly is attached to a first side of the holster body. The shape of the clasp assembly and ring assembly have a symmetrical shape so that the clasp assembly can be positioned and inserted into the ring assembly from either the first side of the holster body or the second side of the holster body. If the shapes of the clasp assembly and ring assembly are not symmetrical the device will not function correctly. FIG. 5 is a preceptive view of the firearm holster body 107 having clasp assembly being positioned to engage the ring assembly. FIG. 6A is a cross sectional side view of the firearm holster having clasp assembly 170 engaging the ring assembly 150 with the catch tabs 525 in an inward position, according to an example embodiment. FIG. 6B is a cross sectional side view of the firearm holster having clasp assembly engaging the ring assembly with the catch tabs 525 in an outward position, according to an example embodiment.

The clasp assembly 150 is configured such that it will fit within the inward facing wall 415 of the ring assembly. The purpose of the clasp assembly is so that the hook assembly 160 may be attached on either the first side of the second side of the holster body 107. The clasp assembly fastens the hook assembly to the ring assembly so that the user may attach the holster body to either inside a person's waistband or outside a person's waistband. In the present embodiment, the shape of the clasp assembly is a substantially oval shaped body or clasp body 171. However, it is understood that other shapes may be used which are within the spirit and scope of the present invention and are configured to be secured within a ring assembly. The clasp body is shaped so that when it is secured within the ring assembly clasp body it does not substantially protrude outward from the sides of the holster body such that it does not interfere with items around the holster body. In the present embodiment, the clasp body 171 defines a housing for mounting a biasing element 530 that is configured for providing an outward force away from a longitudinal centerline of the clasp body. In the present embodiment, the longitudinal centerline of the clasp body is illustrated as hashed line A illustrated in FIGS. 6A and 6B. in the present embodiment, the biasing element is a V-shaped biasing element 530 that is configured for providing a continuously biasing force that pushes at least one catch tab or prong 525 at least outward from the longitudinal centerline of the clasp body. While the present embodiment uses a V-shaped biasing element, it is understood that other outwardly biasing elements may be used, such as a compression spring, magnets etc., which provide a force (represented by arrowed lines B) away from the longitudinal centerline of the clasp body such that at least one tab is pushed outwards. In the present embodiment, the clasp body housing has a cavity 605 defining space such that catch tabs move inward and outward, to and away from the longitudinal centerline of the main body. However other embodiments may be used and are within the spirit and scope of the present invention. The clasp assembly further defines a positioning tab that protrudes outward from a perimeter of the clasp assembly. In the present embodiment, the positioning tab and catch tabs are substantially rectangular shaped. However, other shapes may be used that are within the spirit and scope of the present invention. In the present embodiment, the positioning tab 520 is not biased outward. However, in other embodiments, the positioning tab may also be biased outward. The positioning tab is located at the apex of the substantially oval shaped body; however, other locations may also be used and are within the spirit and scope of the present invention.

The catch tabs 525 are configured for being received by catch tab cavities 425 that are disposed along the inward facing wall 415 of the ring-shaped body. Each catch tab is configured to move between an inward position, as illustrated in FIG. 6A, and an outward position as illustrated in FIG. 6B. The catch tabs are continually biased outward in the direction of arrowed line B toward the outward position or configuration by the V-shaped biasing element 530. To move the catch tabs to the inward configuration, a user must apply force to the catch tabs in the direction of arrowed line C to overcome the outwardly biasing force of the V-shaped biasing element. In the present embodiment, the catch tabs include a grip or finger tab 531 so that a user can apply force, in the direction of arrowed lines C, so that the user may move the catch tabs from the outward position configuration into the inward configuration. When the catch tabs are in the inward configuration, the user may be able to remove the clasp assembly from within the ring assembly so that the user may move or position the hook assembly on either side of the holster body 107.

The positioning tab 520 is configured to be received by the positioning cavity 420 along the inward facing wall of the ring-shaped body. Because the positioning tab protrudes from the perimeter of the clasp assembly, it allows a user to position the clasp assembly so that it is aligned inside the inward facing wall 415 of the ring assembly. The clasp assembly locks the hook assembly relative to the ring assembly when the at least one positioning tab is positioned in the positioning cavity and the at least one catch tab is positioned in the catch cavity. In operation, in order to attach the clasp assembly to the ring assembly, a user will first position the positioning tab 520 into the positioning tab cavity 420. Next, the user will apply an inward force to the outwardly biasing V-shaped element, in the direction of arrowed lines C, so that the catch tabs move from the outward configuration to the inward configuration. Next, the user will position the clasp assembly so that the catch tabs align with the catch tab openings along the inward facing wall of the ring-shaped body. Next, the user will remove the force from the catch tabs so that the V-shaped outward biasing element 530 provides a force to continuously bias the catch tabs into the catch tab cavity thereby locking the clasp assembly into the ring assembly. The hook assembly locks relative to the ring assembly when the positioning tab of the clasp assembly is positioned in the positioning cavity of the ring assembly and each catch tab of the hook assembly is biased outward by a biasing element of the hook assembly and positioned in a catch cavity of the ring assembly. In order to remove the clasp assembly from the ring assembly, the user will apply force, and the direction of line C, so that the catch tabs move into the inward configuration so that the user can then remove the positioning tab from the positioning cavity and remove the clasp assembly from the ring assembly.

Figure 7A:
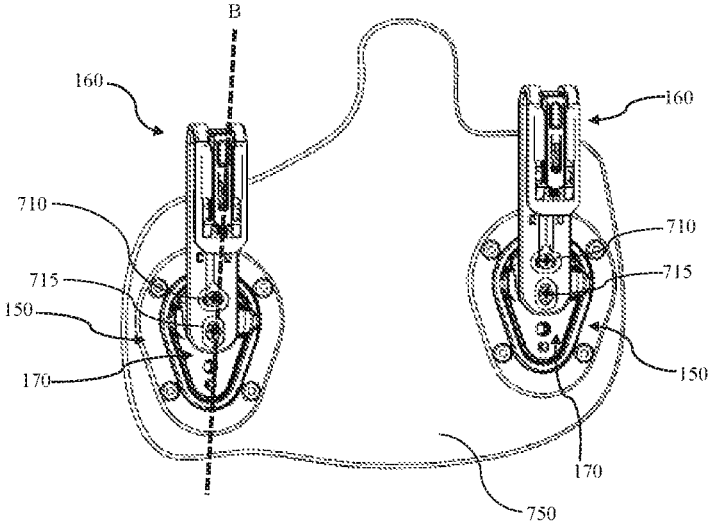
FIG. 7A is a perspective view of a hook assembly attached to each ring assembly by the clasp assembly on a first side of the holster body, according to an example embodiment.
Figure 7B:
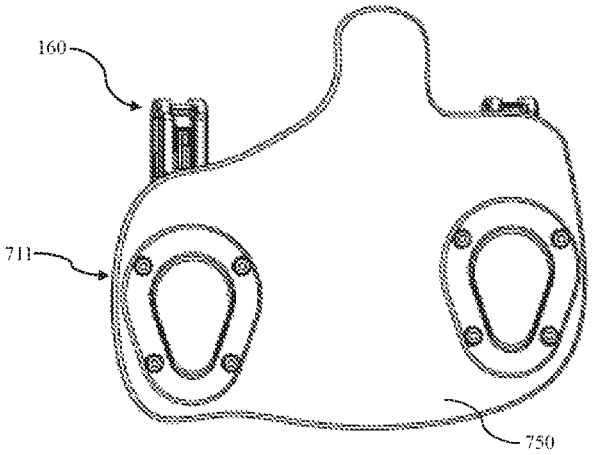
FIG. 7B is a perspective view of a hook assembly attached to each ring assembly by the clasp assembly on a second side of the holster body, according to an example embodiment.

FIG. 7A is a perspective view of a hook assembly 160 attached to each ring assembly 150 by the clasp assembly 170 on a first side 750 of the holster body, according to an example embodiment. FIG. 7B is a perspective view of a hook assembly attached to each ring assembly by the clasp assembly on a second side 711 of the holster body, according to an example embodiment. FIGS. 7A and 7B illustrate the hook assembly, using the clasp assembly can be easily attached to either the first side 750 with a second side 711 of the of the holster body 107 so that the hook assembly 168 to be positioned to hook onto items on either the first side or second side of the holster body. A pair of fasteners, 710, 715 may be used for attaching the hook assembly to the clasp assembly. A variety of different methods and faster that may be used for attaching the hook assembly to the clasp assembly. The fasteners may include a hook, bolt, threaded screw, washer, screw threaded bolt openings clasps etc. However; other types of fasteners may also be used and are within the spirit and scope of the present invention. The present embodiment, openings on longer portion of the body of the hook assembly has openings that are configured for allowing fasteners to pass through the hook by to be attached to the clasp assembly. The fasteners and openings on either the hook assembly or clasp assembly may be such that it allows an amount of play so that the angle of the longitudinal axis, represented by line B, of the hook assembly relative to the clasp assembly may be slightly adjusted for the user's operational preference. Additionally, the clasp assembly may also include additional threaded opening 790 or other openings for receiving fasteners for positioning the hook assembly at various positions on the clasp assembly.

Figure 8A:
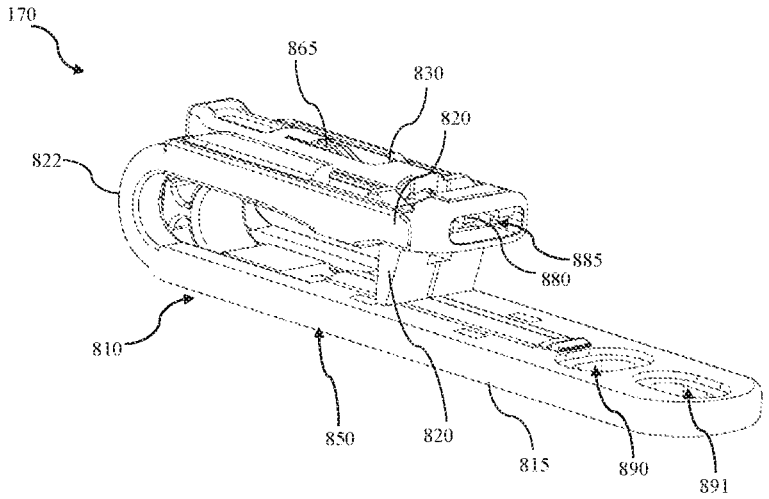
FIG. 8A is a perspective view of a retractable tooth of the hook assembly, wherein the hook assembly is in a locked configuration, according to an example embodiment.
Figure 8B:
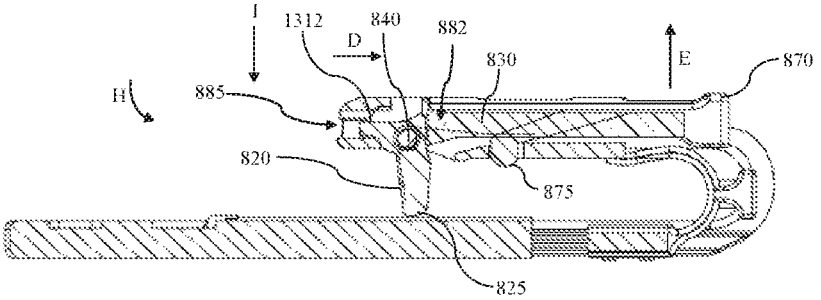
FIG. 8B is a side cross sectional view of the retractable tooth of the hook assembly, wherein the hook assembly is in the locked configuration, according to an example embodiment.
Figure 8C:
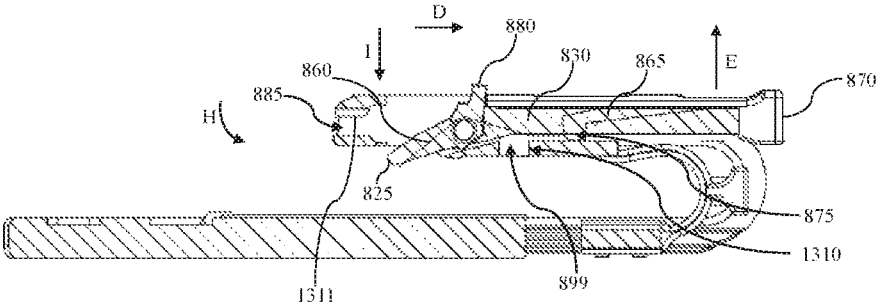
FIG. 8C is a side cross sectional view of the retractable tooth of the hook assembly, wherein the hook assembly is in an unlocked configuration, according to an example embodiment.

FIG. 8A is a perspective view of a retractable tooth 820 of the hook assembly 170, wherein the hook assembly is in a locked configuration, according to an example embodiment. FIG. 8B is a side cross sectional view of the retractable tooth of the hook assembly, wherein the hook assembly is in the locked configuration, according to an example embodiment. FIG. 8C is a side cross sectional view of the retractable tooth of the hook assembly, wherein the hook assembly is in an unlocked configuration, according to an example embodiment. The hook assembly 170 is defined by a hook shaped body 810 defining a longer portion 850, a shorter portion 820 and a curved portion 822. Each of the hook assemblies are configured to attach the holster body to at least one of a waistband and a belt 125 of the wearer. The clasp assembly is configured for removably attaching the hook assembly to the ring assembly such that the hook assembly is positioned on at least one of a first side of the holster body in a first configuration and on a second side of the holster body in a second configuration. In the first configuration the hook assembly is configured to hook onto the waistband for when the holster body is worn inside the wearer's waistband (as illustrated in FIG. 1A). In the second configuration the hook assembly is configured to hook onto at least one of the belt and waistband for when the holster body is worn outside the wearer's waistband (as illustrated in FIGS. 1B and 1C). It is also understood that the holster may also be configured such that it may be attached on either the left side or right side of a person's body.

The longer portion of the hook assembly may have openings, 890, 891 that are configured for allowing the fasteners 715, 710 on the clamp assembly to attach the hook assembly to the clasp body. In the present embodiment, the fasteners 715, 710 or threaded screws that are configured for being received within matching threaded openings disposed on the clasp body 510. Surrounding the openings 890, 891 are recesses that allow play so that the angle between the longitudinal axis of the hook assembly may be adjusted relative to the longitudinal centerline of the clasp assembly.

The retractable tooth 820 is configured to move between a locked configuration, as illustrated in FIGS. 8A and 8B, and an unlocked configuration, as illustrated in FIG. 8C. The retractable tooth is pivotally or hingedly connected with a tooth extension 830. In the present embodiment, the retractable tooth defines a substantially rectangular shape body. However, other shapes may be used that are within the spirit and scope of the present of the present invention. The retractable tooth has an end wall 825. In the locked configuration, the retractable tooth is configured to span from the longer portion to the shorter portion such that a tooth end wall is proximate to the longer portion in the tooth and such that the retractable tooth acts as a stop for preventing the hook assembly from moving relative to the belt of the wearer. In the unlocked configuration the retractable tooth is positioned such that the tooth end wall 825 is proximate to the shorter portion and such that the retractable tooth does not act as a stop for preventing the hook assembly from moving relative to the belt of the wearer.

The tooth extension is configured to be mounted in a shorter portion cavity 882 of the shorter portion 820 of the hook shaped body. In the present embodiment, the tooth extension is a substantially elongated shaped body that is configured to be mounted within the shorter portion cavity 882. The tooth extension is configured to translate longitudinally along the longitudinal axis of the shorter portion 820. A tooth extension handle 870 protrudes outward from the tooth extension and is configured to be engaged by the user from an outward facing surface or side of the shorter portion of a hook shaped body. The tooth extension 830 further defines an elongated biasing element 865 that extends from the tooth extension body. The elongated biasing element is configured to continuously bias inward in the direction of arrowed line I unless sufficient force acts upon it in opposing direction. In the fully unlocked configuration, as illustrated in FIG. 8C, a terminating end 875 of the elongated biasing element is positioned outside of a terminating end space 899. In the fully locked configuration, as illustrated in FIG. 8B, the terminating end of the elongated biasing element is positioned in the terminating space 899. When in the fully locked configuration, the elongated biasing element is configured to provide an inward biasing force, in the direction of arrowed line I, that maintains the terminating end within the terminating end space unless an outward force, in the direction of arrowed line E, overcomes the biasing force provided by the elongated biasing element.

A torsion spring 860 engages the retractable tooth and continuously biases the retractable tooth, in the direction represented by arrowed line H, into the locked configuration unless an opposing force, in the direction of arrowed line D, acts on the tooth extension handle with sufficient force to overcome the force provided by the torsion spring so that the tooth moves in the direction of arrowed line E. The retractable tooth also includes a neck 880 that protrudes from the body of the retractable tooth. The neck is configured to enter into a receiving channel 885 within the shorter portion of the hook shaped body. The neck receiving channel is configured for receiving the neck when the tooth is in the locked configuration. When in the locked configuration, and the neck of the retractable tooth is positioned within the neck receiving channel, it makes it more difficult for a user to accidentally unlock the retractable tooth when using the device. The present embodiment provides a stop having multiple locks for preventing the hook assembly from moving relative to the belt or waistband of the user. The force provided by the torsion spring 860, force provided by the elongated biasing element 865, and frictional force provided by the neck 880 received within the neck receiving channel 885 facilitate maintaining the retractable tooth in the locked configuration.

In operation in order to install the hook assembly onto a person's waistband, a person will have to move the retractable tooth from the locked configuration to the unlocked configuration. In order to move the retractable tooth from the locked configuration to the unlocked configuration, the user will have to apply force to handle 870, in the direction of arrowed line D. As force is applied to the handle 870 in the direction of arrowed line D, this causes an upward force, in the direction of arrowed line E, to be applied onto the elongated biasing element because a portion of the terminating end 875 pushes against the wall 1310. As upward force is applied to the terminating end 875 in the direction of arrowed line E, the terminating end 875 is moved out of the terminating end space 890 from the locked configuration and into the unlocked configuration.

Additionally, to move the retractable tooth from the locked configuration to the unlocked configuration, force in the direction of arrowed line D must applied to the handle or tooth extension to overcome a frictional force caused by surface 1312 of the neck striking the wall 1311.

Additionally, to move the retractable tooth from the locked configuration to the unlocked configuration, force in the direction of arrowed line D must be applied to the tooth extension or handle to overcome the force provided by the torsion spring 860. As force is applied that overcomes the force provided by the torsion spring, the retractable tooth will rotate such that the tooth end wall 825 moves closer to the shorter portion the hook assembly. After the retractable tooth is in the unlocked configuration, a user may position the hook assembly such that a belt or waistband may be received within the throat of the hook. After the belt or waistband at the positioned within the throw, a user may remove the force, in the direction of arrowed line D, applied to the handle 870. After the force in the direction of arrowed line D has been removed, force provided by the torsion spring, in the direction of arrowed line H, will move neck 880 back into the neck receiving channel 885 and move the tooth extension such that the elongated biasing element moves the terminating end 875 into the terminating end space and position the retractable tooth such that the end wall 825 moves proximate to the longer portion of the hook assembly. In the locked configuration the retractable tooth spans from the longer portion to shorter portion such that a tooth end wall of the retractable tooth is proximate to the longer portion and such that the retractable tooth acts as a stop for preventing the hook assembly from moving relative to the waistband of the wearer. In the unlocked configuration the retractable tooth is positioned such that the tooth end wall is proximate to the shorter portion and such that the retractable tooth does not act as a stop for preventing the hook assembly from moving relative to the belt of the wearer.

Figure 9A:
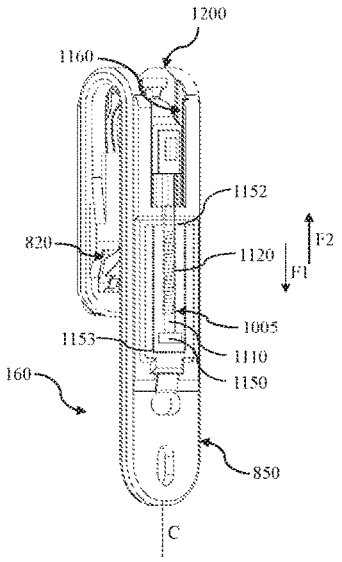
FIG. 9A is a perspective view of a movable hook of the hook assembly, wherein the movable hook is in a first position or storage position, according to an example embodiment.
Figure 9B:
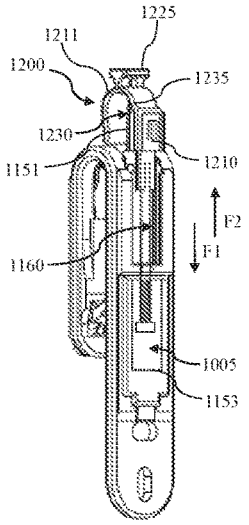
FIG. 9B is a perspective view of the movable hook of the hook assembly, wherein the movable hook is in an extended first position, according to an example embodiment.
Figure 9C:
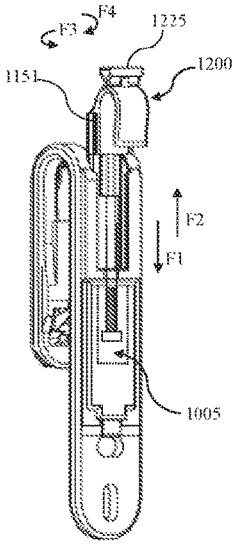
FIG. 9C is a perspective view of a movable hook of the hook assembly, wherein the movable hook has been rotated into an extended second position, according to an example embodiment; and, FIG. 9D is a perspective view of the movable hook of the hook assembly, wherein the movable hook is in a second position or hooking position for maintaining the holster body proximate to the waistband of a wearer, according to an example embodiment.
Figure 9D:
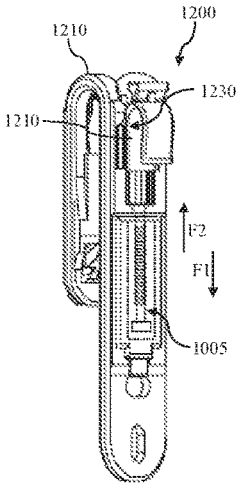

FIGS. 9A-9D best illustrate the movable hook 1120 of the hook assembly 160. The moveable hook may be moved and rotated between a moveable hook first position and a moveable hook second position. The movable hook defines a longer section 1210, and an opposing shorter section 1211 which is connected by the curved section 1235. The throat 1230 is defined by the movable hook and is configured such that the throat of the movable hook receives an upper end 1240 of the holster body (as illustrated in FIG. 1C) such that the movable hook helps maintain the upper end 1240 of the holster body 107 close to the waistband of a user when the holster with the device is attached to the outside of a user's waistband. FIG. 9A is a perspective view of the movable hook 1200 of the hook assembly, wherein the movable hook is in a first position or storage position, according to an example embodiment. In the first position or storage position, the movable hook is configured not to interfere with the user, the user's firearm or the user's clothing or other items outside of the holster body 107. In the movable hook first position, the movable hook throat 1130 is configured to positioned away from the holster body when the hook assembly is attached to the firearm holster (as illustrated in FIGS. 1C and 9D). FIG. 9D is a perspective view of the movable hook of the hook assembly, wherein the movable hook is in a second position or hooking position for maintaining the holster body proximate to the waistband of a wearer (such as illustrated in FIG. 1C). In the movable hook second position, the moveable hook throat 1130 is configured to the hook onto an upper end 1240 of the holster body. FIGS. 9B and 9C illustrate intermediate positions that will be necessary to move the movable hook between the first position and the second position. In other embodiments, the movable hook does not have to be included on the hook assembly.

The longer portion 850 of the hook shaped body of the hook assembly defines a longer portion cavity 1005. The longer portion 1210 of the movable hook is connected with a rod 1110. The rod is positioned longitudinally within the longer portion cavity. The rod is configured to translate longitudinally within the longer portion cavity along a longitudinal axis represented by hashed line C. The rod is also configured such that it may be rotated within the longer portion cavity 1005 in the direction of F3 and F4, but only when the movable hook is in an extended first position (illustrated in FIG. 9B) or an extended second position (illustrated in FIG. 9C), which is further explained below. A stop 1150 is positioned at a terminating end of the rod within the cavity. A downwardly biasing element 1120 is mounted on the rod to engage the stop end wall 1152. The downwardly biasing element is configured to continually provide a downward force, in the direction of arrowed line F1, to continually bias the stop towards end wall 1153. In the present embodiments, the downwardly biasing element is a compression spring. However, in other embodiments other configurations may be used to provide downward force. For example, in other embodiments, other types of springs may be used, magnets may be used, etc. The downwardly biasing element or a compression spring 1120 provides a downward force to the rod such that the moveable hook 1200 is continuously biased toward an end wall 1153 of the longer portion cavity unless upward force, in the direction of arrowed line F2, acts on the rod greater than the downward force provided by the downwardly biasing element. At least one rail 1151 is positioned along the side of the longer portion 1210 of the movable hook. In the present embodiment, a rail is positioned on each side of the movable hook. In the present embodiments, the rail protrudes off from the side of the longer portion of the movable hook however other positions may also be used and are within the spirit and scope of the present invention. Each rail is configured to be received within a mating rail track 1160 disposed along a portion of the longer portion of the hook body. Each rail is configured to translate along a one track when the movable hook moves upward and downward relative to the longer portion of the hook shaped body. Additionally, the rail and rail track facilitate preventing the movable hook from rotating, in the directions illustrated by curved arrowed lines F3 or F4 when the movable hook is in the first position or second position, as illustrated in FIGS. 9A and 9D respectively.

To operate the movable hook to move from the first position (as illustrated in FIG. 9A) to the second position (as illustrated in FIG. 9D), a user will first apply force to the handle 1125 of movable hook to apply an upward force, in the direction of arrowed line F2, that is greater than the downward force, in the direction of arrowed line F1, that is provided by the downwardly biasing element or compression spring 1120. The upward force compresses the compression spring as a stop 1150 moves upward within the longer portion cavity 1005. Next, after the portion of the movable hook having the rails 1151 is removed from the track 1160 of the longer portion cavity (as illustrated in FIG. 9C), a user may apply force rotational force to the handle 1225 (in either direction illustrated by curved arrowed lines F3 and F4) so that the hook and rod may be rotated such that it moves into second extended position (as illustrated in FIG. 9C). Next, the user can ensure that the rails 1151 are aligned with the track so that the rails will enter the track when upward force is removed from the handle 1225. Next, the user will remove the upward force so that the movable hook moves into the second position. As upward force is removed, the compression spring pushes against the stop 1150 downward until the stop abuts the end wall 1153. In operation, the user will likely use the movable hook when the device and firearm holster is attached outside of a person's waistband. In operation, the user will first attach the device and firearm holster to the user's waistband. Next, the user may move the movable hook from the first configuration to the second configuration so that when a person sits down or force acts on the grip of the firearm moves away from the body of the user, the movable hook helps maintain the upper part of the firearm body close to the waistband of the user. The materials for the various components of the device may be comprised of material such as carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. The various components of the device may be formed from a single piece or from several individual pieces joined or coupled together. The components of the hosing may be manufactured from a variety of different processes including an extrusion process, a mold, welding, shearing, punching welding, folding etc.

Based upon the above, what has been taught is a method for providing a firearm holster attachable to at least one of inside a wearer's waistband and outside the wearer's waistband. The method includes a. providing at least one ring assembly opening 310 on a holster body 107 of a firearm holster. The ring assembly opening may cut by a tool such as a knife or other cutting mechanism. Each ring assembly opening is configured for receiving a ring assembly. The above also teaches providing at least one ring assembly 150, Wherein each ring assembly is configured to be attached to the at least one ring assembly opening. The above also teaches providing at least one hook assembly 160 configured to attach the holster body to at least one of a waistband and a belt of the wearer. The above also teaches providing a clasp assembly 170 attached to each hook assembly, wherein the clasp assembly is configured for removably attaching the hook assembly to the ring assembly such that the hook assembly is positioned on at least one of a first side 750 of the holster body in a first configuration and on a second side 711 of the holster body in a second configuration, wherein in the first configuration the hook assembly is configured to hook onto the waistband when the holster body is worn side the wearer's waistband, and wherein in the second configuration the hook assembly is configured to hook onto at least one of the belt and waistband when the holster body is worn outside the wearer's waistband.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A device for attaching to a firearm holster such that a holster body of the firearm holster is attachable to at least one of inside and outside a wearer's waistband, the device comprising:

at least one ring assembly having a ringed shaped body defining an inward facing wall that extends through a hole spanning from a holster body first side to a holster body second side, where the least one catch cavity is along the inward facing wall;

at least one hook assembly having a hook shaped body defining a longer portion, a shorter portion and a curved portion, wherein the at least one hook assembly is configured to attach the holster body to at least one of a waistband and a belt of the wearer;

a clasp assembly attached to the hook assembly and removably attachable to the ring assembly in at least one of a first configuration and a second configuration, where the clasp assembly has an outward biasing element that biases at least one catch tab outward and to be received by said catch cavity when the clasp assembly is attached to the ring assembly;

wherein in the first configuration the hook assembly is attached to the clasp assembly and positioned on the holster body first side; and, wherein in the second configuration the hook is attached to the clasp assembly and positioned on the holster body second side.

2. The device of claim 1, wherein the ring assembly further comprises:

at least one positioning cavity along the inward facing wall wherein each positioning cavity defines a positioning cavity wall extending outward from an inward facing surface of the inward facing wall;

where the least one catch cavity along the inward facing wall defines a cavity wall extending outward from the inward facing surface of the inward facing wall;

a flanged portion for attaching the ring-shaped body to at least one of the first side and second side of the holster body; and, a flanged portion opening along the flanged portion, each flanged portion opening for receiving a fastener, wherein the fastener is for attaching the ring-shaped body to the holster body.

3. The device of claim 2, wherein the clasp assembly further comprises:

at least one positioning tab protruding outward from a perimeter of the clasp assembly, where each positioning cavity is configured to receive and catch each positioning tab when the clasp assembly attaches the hook assembly to the ring assembly; and, where the clasp assembly locks the hook assembly relative to the ring assembly when the at least one positioning tab is positioned in the positioning cavity and the at least one catch tab is positioned in the catch cavity.

4. The device of claim 1, wherein the longer portion of the hook shaped body of the hook assembly is configured to be in attachment with the clasp assembly, and wherein the hook assembly further comprises:

a longer portion cavity defined by the longer portion of the hook shaped body;

a rod positioned within the longer portion cavity, the rod configured to translate along a longitudinal axis of the longer portion cavity;

a movable hook attached to the rod, the movable hook moveably engaging with the longer portion of the hook shaped body;

a downwardly biasing element mounted on the rod;

the longer portion cavity configured for having the rod and downwardly biasing element therein;

the downwardly biasing element for providing a downward force to the rod such that the movable hook is continuously biased toward an end wall of the longer portion cavity unless an upward force acts on the rod greater than the downward force provided by the downwardly biasing element;

wherein the movable hook may be moved and rotated between a first movable hook configuration and a second movable hook configuration;

wherein in the first movable hook configuration, a movable hook throat is configured to be positioned away from holster body when the hook assembly is attached to the holster; and, wherein in the second movable hook configuration, the movable hook throat is configured to the hook onto the holster body when the hook assembly is attached to the holster.

5. The device of claim 4, wherein the hook assembly further comprises:

at least one track along the longer portion of the hook shaped body;

at least one rail along the movable hook; and;

wherein the at least one rail is configured to translate along the at least one track when the movable hook moves upward and downward relative to the longer portion of the hook shaped body.

6. The device of claim 1, wherein a handle is attached to the movable hook and is configured for allowing the wearer to move and rotate the movable hook between a first movable hook configuration and a second movable hook configuration.

7. The device of claim 4, wherein the hook assembly further includes a retractable tooth configured to move between a locked configuration and an unlocked configuration;

wherein in the locked configuration, the retractable tooth spans from the longer portion to shorter portion such that a tooth end wall is proximate to the longer portion and such that the retractable tooth acts as a stop for preventing the hook assembly from moving relative to the belt of the wearer; and, wherein in the unlocked configuration, the retractable tooth is positioned such that the tooth end wall is proximate to the shorter portion and such that the retractable tooth does not act as a stop for preventing the hook assembly from moving relative to the waistband of the wearer.

8. The device of claim 7, wherein the hook assembly further comprises:

a tooth extension pivotally connected with the retractable tooth, the tooth extension configured to be mounted in a shorter portion cavity of the shorter portion of the hook shaped body;

a tooth extension handle protruding from the tooth extension and configured to be engaged by the wearer from an outward facing side of the shorter portion of the hook shaped body;

a torsion spring engaging the retractable tooth and continuously biasing the retractable tooth into the locked configuration unless an opposing force acts on the tooth extension handle;

a neck protruding from the retractable tooth;

a neck receiving channel within the shorter portion of the hook shaped body, the neck receiving channel for receiving the neck when the tooth is in the locked configuration; and, the tooth extension further defining an elongated biasing element, the elongated biasing element configured to bias inward, wherein in the fully unlocked configuration a terminating end of the elongated biasing element is positioned outside of a terminating end space, wherein in the fully locked configuration the terminating end of the elongated biasing element is positioned in the terminating end space, and wherein the elongated biasing element provides a biasing force that maintains the terminating end within the terminating end space unless an outward force overcomes the biasing force provided by the elongated biasing element.

9. A firearm holster attachable to at least one of inside a wearer's waistband and outside the wearer's waistband, the firearm holster comprising:

a holster body having a holster first side and a holster second side and configured for receiving a firearm;

at least one ring assembly opening on the holster body, each ring assembly opening configured for receiving a ring assembly, wherein each ring assembly is configured to be attached to the at least one ring assembly opening and having a ringed shaped body defining an inward facing wall that extends through a hole spanning from a holster body first side to a holster body second side, where the least one catch cavity is along the inward facing wall;

at least one hook assembly configured to attach the holster body to at least one of a waistband and a belt of the wearer;

a clasp assembly attached to each the hook assembly, wherein the clasp assembly is removably attachable to the ring assembly in at least one of a first configuration and a second configuration, where the clasp assembly has an outward biasing element that biases at least one catch tab outward and to be received by said catch cavity when the clasp assembly is attached to the ring assembly;

wherein in the first configuration the hook assembly is attached to the clasp assembly is positioned on the holster body first side; and, wherein in the second configuration, the hook assembly is attached to the clasp assembly is positioned on the holster body second side.

10. The firearm holster of claim 9, wherein ring assembly comprises:

an inward facing wall defined by a ringed shaped body;

at least one positioning cavity defined along the inward facing wall wherein each positioning cavity defines a positioning cavity wall extending outward from an inward facing surface of the inward facing wall;

at least one catch cavity defined along the inward facing wall defines a cavity wall extending outward from the inward facing surface of the inward facing wall;

a flanged portion for attaching the ring-shaped body to at least one of the first side and second side of the holster body; and, a flanged portion opening along the flanged portion, each flanged portion opening for receiving a fastener to attach, wherein the fastener is for attaching the ring-shaped body to the holster body.

11. The firearm holster of claim 9, wherein the clasp assembly further comprises:

at least one positioning tab protruding outward from a perimeter of the clasp assembly, wherein each positioning cavity is configured to receive and catch each positioning tab when the clasp assembly attaches the hook assembly to the ring assembly; and, where the clasp assembly locks the hook assembly relative to the ring assembly when the at least one positioning tab is positioned in the positioning cavity and the at least one catch tab is positioned in the catch cavity.

12. The firearm holster of claim 9, wherein the longer portion of the hook shaped body of the hook assembly is configured to be in attachment with the clasp assembly, and wherein the hook assembly further comprises:

a longer portion cavity defined by the longer portion of the hook shaped body;

a rod positioned within the longer portion cavity configured to translate along a longitudinal axis of the longer portion cavity;

a movable hook attached to the rod, the movable hook engaging with the longer portion of the hook shaped body;

a downwardly biasing element mounted on the rod;

the longer portion cavity configured for having the rod and downwardly biasing element therein;

the downwardly biasing element for providing a downward force to the rod such that the movable hook is continuously biased toward an end wall of the longer portion cavity unless an upward force acts on the rod greater than the downward force provided by the downwardly biasing element;

wherein the movable hook may be moved and rotated between a first movable hook configuration and a second movable hook configuration;

wherein in the first movable hook configuration a movable hook throat is configured to be positioned away from holster body when the hook assembly is attached to the holster; and, wherein in the second movable hook configuration, the movable hook receiving portion is configured to the hook onto the holster body when the hook assembly is attached to the holster.

13. The firearm holster of claim 12, wherein the hook assembly further comprises:

at least one track along the longer portion of the hook shaped body;

at least one rail along the movable hook; and;

wherein the at least one rail is configured to translate along the at least one track when the movable hook moves upward and downward relative to the longer portion of the hook shaped body.

14. The firearm holster of claim 9, wherein a handle is attached to the movable hook and is configured for allowing the wearer to move and rotate the movable hook between the first movable hook configuration and the second movable hook configuration.

15. The firearm holster of claim 12, wherein the hook assembly further includes a retractable tooth configured to move between a locked configuration and an unlocked configuration;

wherein in the locked configuration the retractable tooth spans from the longer portion to shorter portion such that a tooth end wall is proximate to the longer portion and such that the retractable tooth acts as a stop for preventing the hook assembly from moving relative to the waistband of the wearer; and, wherein in the unlocked configuration, the retractable tooth is positioned such that the tooth end wall is proximate to the shorter portion and such that the retractable tooth does not act as a stop for preventing the hook assembly from moving relative to the waistband of the wearer.

16. The firearm holster of claim 15, wherein the hook assembly further comprises:

a tooth extension pivotally connected with the retractable tooth, the tooth extension configured to be mounted in a shorter portion cavity of the shorter portion of the hook shaped body;

a tooth extension handle protruding from the tooth extension and configured to be engaged by the wearer from an outward facing side of the shorter portion of the hook shaped body;

a torsion spring engaging the retractable tooth and continuously biasing the retractable tooth into the locked configuration unless an opposing force acts on the tooth extension handle;

a neck protruding from the retractable tooth;

a neck receiving channel within the shorter portion of the hook shaped body, the neck receiving channel for receiving the neck when the tooth is in the locked configuration; and, the tooth extension further defining an elongated biasing element, the elongated biasing element configured to bias inward, wherein in the fully unlocked configuration a terminating end of the elongated biasing element is positioned outside of a terminating end space, wherein in the fully locked configuration the terminating end of the elongated biasing element is positioned in the terminating end space, and wherein the elongated biasing element provides a biasing force that maintains the terminating end within the terminating end space unless an outward force overcomes the biasing force provided by the elongated biasing element.

17. A method for providing a firearm holster attachable to at least one of inside a wearer's waistband and outside the wearer's waistband, the method comprising:

providing at least one ring assembly opening on a holster body of the firearm holster, wherein each ring assembly opening configured for receiving a ring assembly;

providing at least one ring assembly having a ringed shaped body defining an inward facing wall that extends through a hole spanning from a holster body first side to a holster body second side, where the least one catch cavity is along the inward facing wall;

providing at least one hook assembly configured to attach the holster body to at least one of a waistband and a belt of the wearer;

providing a clasp assembly attached to the hook assembly, wherein the clasp assembly is removably attachable to the ring assembly in at least one of a first configuration and a second configuration, where the clasp assembly has an outward biasing element that biases at least one catch tab outward and to be received by said catch cavity when the clasp assembly is attached to the ring assembly;

wherein in the first configuration, the hook assembly attached to the clasp assembly is positioned on the holster body first side; and, wherein in the second configuration, the hook assembly is attached to the clasp assembly is positioned on the holster body second side.

18. The method of claim 17, wherein the method further includes locking the hook assembly relative to the ring assembly when at least one positioning tab of the clasp assembly is positioned in at least one positioning cavity of the ring assembly, and at least one catch tab of the clasp assembly is biased outward by a biasing element of the clasp assembly and positioned in a catch cavity of the ring assembly.

19. The method of claim 17, wherein the method further comprises:

providing a movable hook on the hook assembly, wherein the movable hook may be moved and rotated between a first movable hook configuration and a second movable hook configuration;

wherein in the first movable hook configuration, a movable hook throat is configured to be positioned away from holster body when the hook assembly is attached to the firearm holster; and, wherein in the second movable hook configuration, the movable hook throat is configured to the hook onto the holster body when the hook assembly is attached to the holster.

20. The method of claim 17, wherein method further includes providing the hook assembly having a retractable tooth configured to move between a locked configuration and an unlocked configuration;

wherein in the locked configuration the retractable tooth spans from the longer portion to shorter portion such that a tooth end wall of the retractable tooth is proximate to the longer portion and such that the retractable tooth acts as a stop for preventing the hook assembly from moving relative to the waistband of the wearer; and, wherein in the unlocked configuration, the retractable tooth is positioned such that the tooth end wall is proximate to the shorter portion and such that the retractable tooth does not act as a stop for preventing the hook assembly from moving relative to the belt of the wearer.

* * * * *